US006769215B1

(12) United States Patent
Carkner

(10) Patent No.: US 6,769,215 B1
(45) Date of Patent: Aug. 3, 2004

(54) SYSTEM AND METHOD FOR ENHANCING THE BOND OF ROOFING MEMBRANE TO LIGHTWEIGHT INSULATING CONCRETE

(75) Inventor: Philip M. Carkner, Southlake, TX (US)

(73) Assignee: Siplast, Inc., Irving, TX (US)

( * ) Notice: Subject to any disclaimer, the term of this patent is extended or adjusted under 35 U.S.C. 154(b) by 34 days.

(21) Appl. No.: 10/223,125

(22) Filed: Aug. 19, 2002

(51) Int. Cl.[7] ..... E04B 7/00; E04F 13/00
(52) U.S. Cl. ..... 52/411; 52/746.11; 156/71
(58) Field of Search ..... 52/411, 746.11; 156/71

(56) References Cited

U.S. PATENT DOCUMENTS

| | | | | |
|---|---|---|---|---|
| 3,080,253 A | * | 3/1963 | Dietz et al. | 138/146 |
| 4,160,346 A | | 7/1979 | Kaufmann | 52/96 |
| 4,606,963 A | | 8/1986 | Farrell | 428/150 |
| 4,617,221 A | | 10/1986 | von der Chys | 428/139 |
| 4,761,313 A | | 8/1988 | Jacobs | 427/407 |
| 4,803,111 A | | 2/1989 | Mansell | 428/139 |
| 5,309,685 A | | 5/1994 | Rathgeber et al. | 52/58 |
| 5,431,962 A | | 7/1995 | Glass et al. | 427/403 |
| 5,645,664 A | * | 7/1997 | Clyne | 156/71 |
| 5,711,116 A | | 1/1998 | Hasan | 52/58 |
| 5,787,668 A | | 8/1998 | Carkner et al. | 52/408 |
| 6,286,279 B1 | * | 9/2001 | Bean et al. | 52/390 |

OTHER PUBLICATIONS

"Roofing Membranes", www.siplast.com 1 page Jul. 18, 2002.
"Commercial product Data Sheet—Paradiene 20 TS", Siplast, Inc. 3 pages, 1/02.
"Colvent—A Whole New Approach to Relieving Stress", Soprema 2 pages 5/02.

* cited by examiner

*Primary Examiner*—Robert Canfield
(74) *Attorney, Agent, or Firm*—Akin Gump Strauss Hauer & Feld, LLP

(57) ABSTRACT

A roof structure includes a lightweight insulating concrete layer, a waterproof membrane overlying the concrete layer, and a plurality of adhesive pellets that are at least partially embedded in the concrete layer. At least some of the adhesive pellets are in contact with an adhesive layer of the waterproof membrane so that the waterproof membrane and the concrete layer are both adhesively bonded together.

20 Claims, 3 Drawing Sheets

SYSTEM AND METHOD FOR ENHANCING THE BOND OF ROOFING MEMBRANE TO LIGHTWEIGHT INSULATING CONCRETE

BACKGROUND OF THE INVENTION

This invention relates to roofing structures, and more particularly to a system and method for enhancing the bond of roofing membranes to lightweight insulating concrete.

Roofing structures often include a roofing deck followed by one or more layers of lightweight insulating concrete and a roofing membrane. Roofing membranes typically comprise multiple plies of bituminous felt material that are sealed together and to the concrete layer with flood pourings of hot roofing asphalt. It has been found, however, that full adhesion of the roofing membrane to the concrete layer is prevented by imperfections on the surface of the concrete layer, such as surface dusting, soft spots, and/or low spots. Consequently, isolated air pockets may form between the concrete layer and the roofing membrane, thereby decreasing the strength of the interfacial bond formed between the two layers. In addition, moisture that may be trapped in the pockets can cause the formation of bubbles and subsequent leaks in the roofing membrane, especially on hot days where expansion of the water vapor occurs. Moreover, the water-to-cement ratio for lightweight insulating concrete is typically several times that of conventional structural cement in order to render the material sufficiently fluid for placement on the roof platform. The bituminous plies are often installed before the concrete is completely cured and dried, due to the uneconomical delay in the curing and drying process. Consequently, air and moisture can easily become trapped within pockets beneath the membrane layer. In addition, external sources of moisture, such as humidity or rain, may also cause the build-up of moisture beneath the waterproofing layer.

In an effort to overcome these problems, the prior art has proposed various solutions that provide adequate ventilation between the concrete and membrane layers. However, the predictability of the adhesion strength between the layers and/or the cost of such solutions are often compromised. By way of example, U.S. Pat. No. 4,803,111 to Mansell discloses a membrane roofing system wherein a thin, perforated non-bituminous sheet of underlay material is installed over a substrate. An adhesive is applied over the underlay material and onto the substrate at areas exposed by the perforations. A membrane layer is then placed over the underlay material so that vapor trapped between the membrane and substrate can disperse through the areas of non-adhesion between the membrane and substrate. However, this system suffers from unpredictable adhesion strength due to the aforementioned surface defects of the concrete layer.

Thus, the interfacial bonds between the concrete and membrane layers of the foregoing solutions may not be as strong as desired, subjecting the roofing system to premature failure due to a phenomenon known as "wind uplift." According to this phenomenon, the lateral movement of air (wind) over the top surface of the roofing system causes a reduction in air pressure above the roof, similar to air pressure reduction which occurs over an airplane wing in flight. The reduced air pressure above the roofing system imparts forces orthogonal to the plane of the roofing system, resulting in "uplift" of the roof assembly. These forces tend to pull apart the various layers of the composite roofing systems described above, thereby inducing failure of the roofing system.

Wind, downward load, seismic activity and other phenomena may also impart lateral forces along the face of the top layer of the roofing system, and these lateral forces are often transmitted to the lower insulating layers. Such lateral forces, also designated as horizontal shear forces, may contribute to wind uplift failure, particularly when acting in conjunction with transverse forces associated with wind uplift. They may also decrease the downward load capacity of the roofing system. Because of their susceptibility to this type of failure, such composite roofing systems may fail to meet increasingly stringent building codes, insurance requirements, and other regulatory requirements, particularly in geographic regions where strong winds are common.

In view of the above problems associated with adhesively secured roof membrane systems, the preferred method for the past 30 years has been to mechanically fasten the first ply of the membrane directly to the lightweight insulating concrete. Although this method allows vapor to flow freely between the membrane and concrete layers and ensures a predictable bond between the layers, the cost of mechanical fasteners as well as the requisite skilled labor and installation time are disadvantages which heretofore have been difficult to overcome.

Accordingly, it is desirable to provide a system and method for attaching a waterproof membrane layer to a lightweight insulating concrete layer that permits vapor flow and ensures a predictable bond between the layers without the use of mechanical fasteners.

BRIEF SUMMARY OF THE INVENTION

In accordance with one aspect of the invention, a roof structure comprises a lightweight insulating concrete layer and a waterproof membrane layer overlying the concrete layer. The waterproof membrane layer has a first ply of waterproof material and a first adhesive layer on the first ply. The roof structure also comprises a plurality of adhesive pellets at least partially embedded in the concrete layer. At least some of the adhesive pellets are in contact with the first adhesive layer of the first ply to thereby adhesively bond and mechanically connect the waterproof membrane layer to the lightweight insulating concrete layer.

In accordance with a further aspect of the invention, a roof structure comprises a lightweight insulating concrete layer with a mixture of Portland cement and at least one aggregate material taken from the group consisting of vermiculite, perlite or pregenerated cellular foam. A waterproof membrane layer overlies the concrete layer. The waterproof membrane layer comprises a first ply of waterproof material with a first heat responsive adhesive layer and a second ply of waterproof material with a second heat responsive adhesive layer bonded to the first ply to thereby secure the first and second plies together. The first adhesive layer has a plurality of spaced adhesive elements on an underside of the first ply, with spaces between the adhesive elements forming vent pathways for vapor movement and vapor pressure relief between the first ply and the concrete layer. A plurality of heat responsive adhesive pellets are at least partially embedded in the concrete layer. The adhesive pellets are melted together with the spaced adhesive elements of the first adhesive layer to thereby adhesively bond and mechanically connect the waterproof membrane layer to the lightweight insulating concrete layer.

In accordance with an even further aspect of the invention, a method of constructing a roof structure comprises forming a lightweight insulating concrete layer; distributing a plurality of adhesive pellets over the concrete layer while the concrete layer is in the plastic state so that the adhesive pellets are at least partially embedded in the concrete layer; at least partially curing the concrete layer so that the adhesive pellets are mechanically secured to the concrete layer; providing a waterproof membrane layer having a first ply of waterproof material and a first adhesive layer on a lower surface of the first ply; and engaging at least some of the adhesive pellets with the first adhesive layer to thereby adhesively bond and mechanically connect the first ply to the concrete layer.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

The invention will now be described in greater detail with reference to the drawings, wherein like parts throughout the drawing figures are represented by like numerals.

DETAILED DESCRIPTION OF THE PREFERRED EMBODIMENTS

Figure 1:
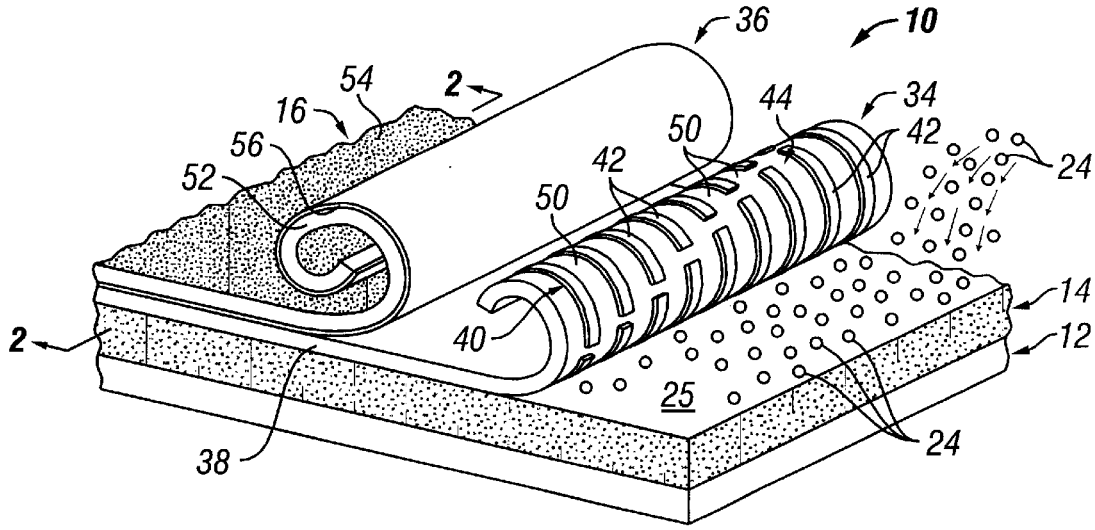
FIG. 1 is a perspective view, in partial cross section, of a roofing assembly in accordance with the present invention.

Referring now to the drawings, and to FIG. 1 in particular, a roofing assembly 10 in accordance with one embodiment of the present invention is illustrated. The roofing assembly 10 includes a roofing deck 12, a lightweight insulating concrete layer 14, and a waterproof membrane layer 16 overlying the concrete layer 14.

The roofing deck 12 is of well-known construction and typically comprises one or more layers of concrete, wood, metal, and/or other materials rigidly connected to and supported by beams or other roofing understructure.

Figure 2:
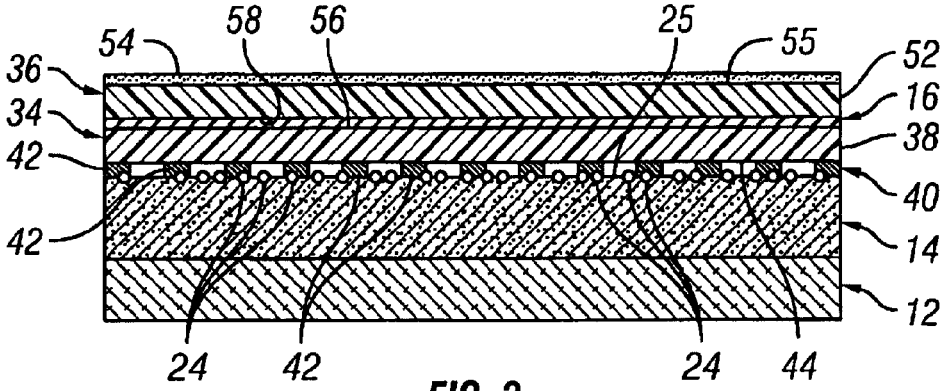
FIG. 2 is a cross section of the roofing assembly taken along line 2—2 of FIG. 1.
Figure 4:
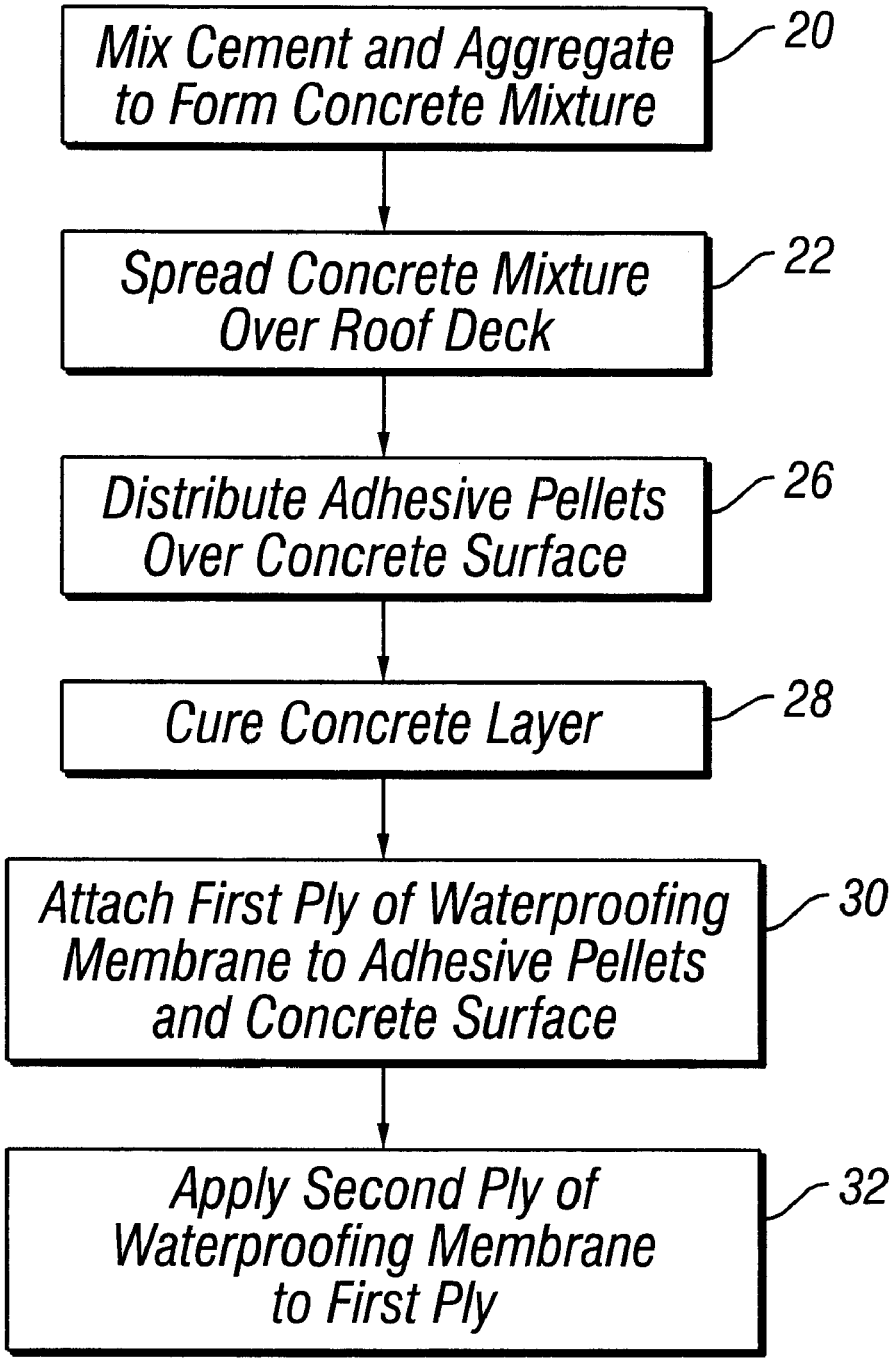
FIG. 4 is a block diagram illustrating a method of constructing the roofing assembly in accordance with the invention.

With additional reference to FIGS. 2 and 4, the lightweight insulating concrete layer 14 is prepared and poured over the roofing deck 12, as shown by blocks 20 and 22 in FIG. 4. Preferably, the concrete layer 14 is constructed of a 1:3.5 ratio of Type I, II or III Portland cement and vermiculite concrete aggregate, such as NVS (Non-Vented Substrate) Vermiculite Concrete Aggregate provided by Siplast, Inc. of Irving, Tex., and sufficient water to make a slurry that can be pumped onto or otherwise applied to the roofing deck 12. For metal roofing decks, the concrete layer is preferably constructed of a 1:6 ratio of Portland cement and vermiculite concrete aggregate. Alternatively, or in addition to the vermiculite concrete aggregate, a pregenerated cellular foam material, preferably formed of hydrolyzed protein or other active surfactant, such as Insulcel™ foam concentrate (also provided by Siplast, Inc.), can be added to the cement. As a further alternative or addition to vermiculite, perlite may be used as a lightweight aggregate. It will be understood that other materials can be mixed with the cement to provide material properties in accordance with the particular roofing requirements.

While the concrete is still in the plastic state on the roofing deck 12, adhesive pellets 24 (FIG. 1) are preferably broadcast onto the upper surface 25 of the concrete layer 14, as shown by block 26 in FIG. 4. The adhesive pellets 24 are preferably constructed of a modified asphalt or petroleum bitumen material, such as Promix® 725 provided by Flow Polymers, Inc. of Cleveland Ohio, with a diameter of about 0.5 mm. Such a material has a specific gravity of approximately 1.05 and a softening point of about 95° C. The density of the pellets 24 is preferably less than or equal to the density of the concrete layer so that the pellets will be partially submersed in the concrete layer and partially exposed at the upper surface 25 for contacting the membrane layer 16, as will be described in further detail below. The adhesive pellets are preferably distributed over the upper surface 25 at a concentration of approximately two to three pounds per 100 square feet. The particular size, density and concentration of the pellets 24 can vary depending on the type of material used for the membrane layer 16, the density of the concrete layer 14, the desired adhesive strength between the concrete and membrane layers, the climatic conditions to which the roofing assembly will be exposed, the anticipated surface defects of the concrete layer 14, such as dusting and soft spots, and so on.

The adhesive pellets 24 can alternatively be formed of other materials, such as hot melt adhesives or reactive elastomers that covalently bond with asphalt materials. A suitable hot melt adhesive can be formed of an ethylene vinyl acetate polyolefin material, such as Hysol® 3X provided by Loctite Corporation. A reactive elastomer can be formed of a random terpolymer comprising ethylene, normal butylacrylate and glycidyl methacrylate. It is believed that the elastomer covalently bonds to the asphaltene molecule when in contact with the asphalt under high temperature. A combination of pellets of different material properties can alternatively be used.

In accordance with a further embodiment of the invention, the adhesive pellets 24 can be mixed with the concrete in sufficient quantity so that at least a portion of the pellets will be partially embedded in the concrete layer 14 and partially exposed at the upper surface 25 of the concrete layer.

Once the pellets 24 have been applied to the concrete layer 14, the concrete is allowed to cure, and thus mechanically trap or secure the pellets 24 in the concrete layer 14. The cure time can be between approximately three and twenty-eight days (block 28 in FIG. 4), depending on the cement type, quantity of water used in the mixture, type and quantity of aggregate or foam material, as well as ambient conditions such as temperature and humidity. Once the concrete has at least partially cured, and preferably at least substantially cured, the waterproof membrane layer 16 is applied over the concrete layer 14 (blocks 30 and 32 in FIG. 4).

As shown in FIGS. 1 and 2, the membrane layer 16 preferably has a base ply 34 that is secured to the concrete layer 14 and a cover ply 36 that is secured to the base ply 34. Preferably, the base ply 34 is constructed of a lightweight random fibrous glass mat 38 impregnated and coated with an elastomeric Styrene-Butadiene-Styrene (SBS) modified bitumen. A partial adhesive layer 40 is applied to the lower surface 44 of the mat 38.

Figure 3:
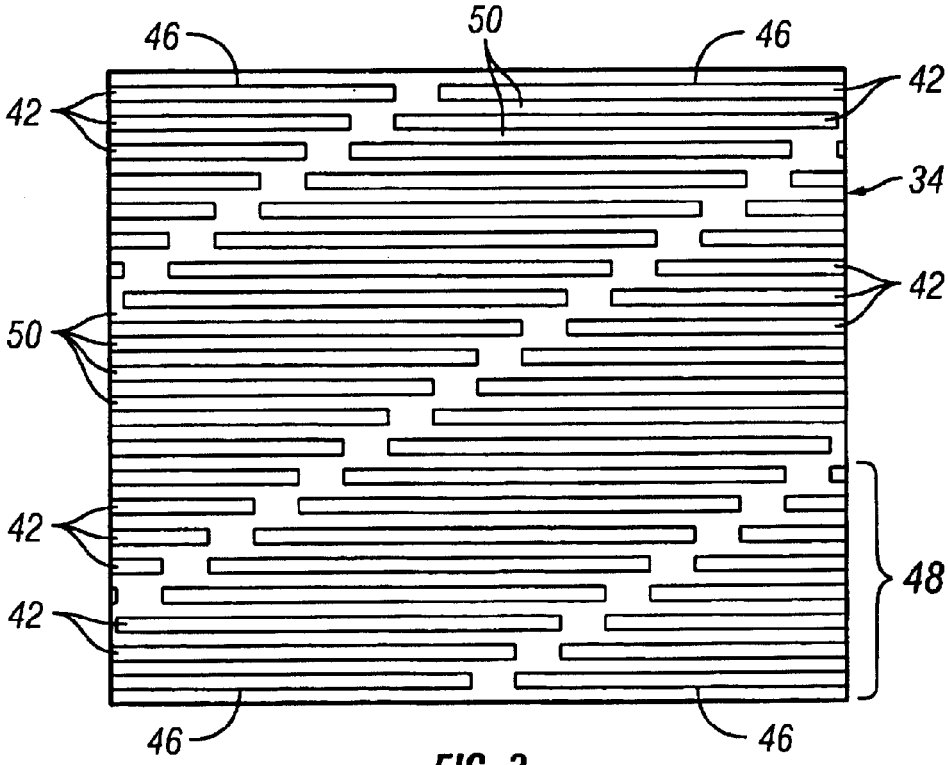
FIG. 3 is a bottom plan view of a first membrane ply that forms part of the roofing assembly.

As shown in FIG. 3, the adhesive layer 40 preferably comprises a plurality of spaced heat responsive adhesive strips 42 that are located in parallel rows 46 and offset columns 46. The spaces 50 between the rows and columns provide pathways for vapor movement and vapor pressure relief for any residual moisture that may be located between the base ply 34 and the concrete layer 14. The adhesive strips 42 are preferably constructed of a heat responsive bitumen material and cover approximately 50% of the lower surface 44, although more or less coverage can be provided. A base ply 34 with the above-described construction is available from Siplast, Inc., under the trade name Paradiene™ 20 TS. It will be understood that other membranes with full or partial adhesion capabilities can be used, depending on the particular application and/or the presence of moisture. Where a partial adhesion ply is used, it will be understood that the adhesive layer 40 is not limited to strips 42, but may be in the form of other adhesive elements such as circles, triangles, squares, arcs, and so on, as well as any combination thereof.

The base ply 34 is preferably secured to the concrete layer 14 (block 30 in FIG. 4) by applying heat to the lower surface 44 of the base ply 34 and the upper surface 25 of the concrete layer 14 at a temperature that is sufficient to melt the adhesive layer 40 and the pellets 24 together. A torch operating at a temperature of approximately 2,000° F. can be used to quickly and efficiently melt the adhesives together. When cooled, the base ply 34 is adhesively secured to the concrete layer 14 through the interaction of the adhesive layer 40 with the concrete surface 25 and the adhesive pellets 24, and is also mechanically secured to the concrete layer due to the embedded nature of the adhesive pellets in the concrete. Thus, the present invention eliminates the need for mechanical fasteners without compromising the predictability of the adhesion strength between the membrane layer 16 and the concrete layer 14.

In addition, it has been found that the adhesion strength between the base ply 34 and the concrete layer 14 is significantly increased over prior art non-fastener solutions. While most areas of the United States currently require a wind uplift resistance of approximately 60 to 90 pounds per square foot (psf) for roofing systems, it has been found that a roofing system constructed in accordance with a preferred embodiment of the present invention was able to resist loads up to 165 psf with no delamination between the membrane layer 16 and the concrete layer 14.

As shown in FIG. 2, the cover ply 36 is also preferably constructed of a lightweight random fibrous glass mat 52 impregnated and coated with an SBS modified bitumen. A finish layer 54, preferably of ceramic granules, is applied to the upper surface 55 of the mat 52, while a full adhesive layer 56 is applied to the lower surface 58 of the mat 52. A cover ply 36 with the above-described construction is available from Siplast, Inc., under the trade name Paradiene™ 30 FR. It will be understood that the base ply 34 can be used alone or with other plies of different material types and constructions, with full or partial adhesion capabilities, depending on the particular construction of the base and/or subsequent plies, as well as the particular roofing application and requirements.

The cover ply 36 is preferably secured to the base ply 34 (block 32 in FIG. 4) by applying heat to the adhesive layer 56 on the lower surface 44 of the cover ply 36 and the upper surface 58 of the base ply 34 at a temperature that is sufficient to melt the adhesive layer 56 and the bitumen coating on the base ply together. Again, a torch operating at a temperature of approximately 2,000° F. can be used to quickly and efficiently melt the adhesives together. When cooled, the cover ply 36 is adhesively secured to the base ply 34.

In yet a further embodiment of the invention, the hot-melt adhesive layer 40 on the lower surface 44 of the base ply 34 can be replaced with an adhesive with a lower temperature softening point so that the adhesive is self-adhering without the application of heat. A backing layer (not shown) may be provided for protecting the adhesive during shipping and storage. With this arrangement, the adhesive layer 40 is pressed against the upper surface 25 of the concrete layer 14 and the exposed portions of the adhesive pellets 24 to thereby adhesively bond and mechanically connect the base ply 34 to the concrete layer 14.

It will be understood that terms of orientation and/or position as may be used herein, such as upper and lower, as well as their respective derivatives and equivalent terms refer to relative, rather than absolute, orientations and/or positions.

It will be appreciated by those skilled in the art that changes could be made to the embodiments described above without departing from the broad inventive concept thereof. By way of example, the roofing system may include fewer layers than described. Alternatively, the roofing system may include more layers than described, such as plural layers of lightweight insulating concrete, foam insulating boards, and so on. It will be understood, therefore, that this invention is not limited to the particular embodiments disclosed, but it is intended to cover modifications within the spirit and scope of the present invention as defined by the appended claims.

I claim:

1. A roof structure having resistance to wind uplift and shear forces, comprising:

a lightweight insulating concrete layer;

a waterproof membrane layer overlying the concrete layer, the waterproof membrane layer comprising a first ply of waterproof material and a first adhesive layer on the first ply; and a plurality of adhesive pellets at least partially embedded in the concrete layer, the adhesive pellets being in contact with the first adhesive layer of the first ply to thereby adhesively bond the waterproof membrane layer to the lightweight insulating concrete layer.

2. A roof structure according to claim 1, wherein the pellets are formed of an asphalt material.

3. A roof structure according to claim 1, wherein the pellets are formed of a hot melt adhesive material.

4. A roof structure according to claim 1, wherein the first adhesive layer comprises a plurality of spaced adhesive elements on an underside of the first ply, with spaces between the adhesive elements forming vent pathways for vapor movement between the first ply and the concrete layer.

5. A roof structure according to claim 4, wherein the adhesive elements are adhesive strips.

6. A roof structure according to claim 4, wherein the first adhesive layer comprises a heat responsive material.

7. A roof structure according to claim 1, wherein the waterproof membrane layer further comprises a second ply of waterproof material adhesively bonded to the first ply.

8. A roof structure according to claim 7, wherein the second ply comprises a second adhesive layer on an underside of the second ply for adhesively bonding the second ply to the first ply.

9. A roof structure according to claim 1, wherein the lightweight insulating concrete layer comprises a mixture of Portland cement and at least one aggregate material taken from the group consisting of vermiculite, perlite or pregenerated cellular foam.

10. A roof structure comprising:

a lightweight insulating concrete layer comprising a mixture of Portland cement and at least one aggregate material taken from the group consisting of vermiculite, perlite or pregenerated cellular foam;

a waterproof membrane layer overlying the concrete layer, the waterproof membrane layer comprising:

a first ply of waterproof material with a first heat responsive adhesive layer, the first adhesive layer having a plurality of spaced adhesive elements on an underside of the first ply, with spaces between the adhesive elements forming vent pathways for vapor movement and vapor pressure relief between the first ply and the concrete layer; and a second ply of waterproof material having a second heat responsive adhesive layer bonded to the first ply to thereby secure the first and second plies together; and a plurality of heat responsive adhesive pellets at least partially embedded in the concrete layer, the adhesive pellets being melted together with the spaced adhesive elements of the first adhesive layer to thereby adhesively bond and mechanically connect the waterproof membrane layer to the lightweight insulating concrete layer.

11. A method of constructing a roof structure having resistance to wind uplift and shear forces, comprising:

forming a lightweight insulating concrete layer;

distributing a plurality of adhesive pellets over the concrete layer while the concrete layer is in the plastic state so that the adhesive pellets are at least partially embedded in the concrete layer;

at least partially curing the concrete layer so that the adhesive pellets are mechanically secured to the concrete layer;

providing a waterproof membrane layer, the waterproof membrane layer comprising a first ply of waterproof material and a first adhesive layer on a lower surface of the first ply; and engaging at least some of the adhesive pellets with the first adhesive layer to thereby adhesively bond and mechanically connect the first ply to the concrete layer.

12. A method according to claim 11, wherein distributing the pellets comprises mixing the pellets with the concrete layer.

13. A method according to claim 11, wherein distributing the pellets comprises broadcasting the pellets over an upper surface of the concrete layer.

14. A method according to claim 13, wherein engaging at least some of the adhesive pellets with the first adhesive layer comprises melting the adhesive pellets and the first adhesive layer together.

15. A method according to claim 14, wherein melting comprises applying sufficient heat to cause the first adhesive layer and the adhesive pellets to reach at least a plastic state.

16. A method according to claim 14, wherein melting comprises applying sufficient heat to cause the first adhesive layer and the adhesive pellets to reach a liquid state.

17. A method according to claim 11, wherein providing the waterproof membrane layer comprises adhering a second ply of waterproof material to the first ply.

18. A method according to claim 17, wherein the second ply comprises a second adhesive layer that is in contact with the first ply.

19. A method according to claim 18, wherein adhering the second ply to the first ply comprises applying sufficient heat to melt the second adhesive layer to the first ply.

20. A method according to claim 19, wherein engaging at least some of the adhesive pellets with the first adhesive layer comprises applying sufficient heat to melt the adhesive pellets and the first adhesive layer together.

* * * * *